US007424257B2

(12) United States Patent
Yoo et al.

(10) Patent No.: US 7,424,257 B2
(45) Date of Patent: Sep. 9, 2008

(54) PAPER GUIDE DEVICE AND IMAGE FORMING APPARATUS HAVING THE SAME

(75) Inventors: In-Sub Yoo, Seoul (KR); Yong-su Kim, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 330 days.

(21) Appl. No.: 11/244,148

(22) Filed: Oct. 6, 2005

(65) Prior Publication Data

US 2006/0083559 A1 Apr. 20, 2006

(30) Foreign Application Priority Data

Oct. 15, 2004 (KR) ..... 10-2004-0082609

(51) Int. Cl.
*G03G 15/16* (2006.01)

(52) U.S. Cl. ..... 399/316; 399/317

(58) Field of Classification Search ..... 399/107, 399/124, 303, 312, 316, 381, 388, 317; 271/255
See application file for complete search history.

(56) References Cited

U.S. PATENT DOCUMENTS

| | | | | |
|---|---|---|---|---|
| 6,912,370 | B2 * | 6/2005 | Iwai | 399/309 |
| 2005/0123328 | A1 * | 6/2005 | Aruga et al. | 399/328 |
| 2007/0057444 | A1 * | 3/2007 | Sagawa et al. | 271/225 |

FOREIGN PATENT DOCUMENTS

| | | |
|---|---|---|
| JP | 2000-231275 | 8/2000 |
| JP | 2000-292988 | 10/2000 |
| JP | 2001-201994 | 7/2001 |
| JP | 2004-020850 | 1/2004 |
| JP | 2004-053865 | 2/2004 |

* cited by examiner

*Primary Examiner*—Hoan H Tran
(74) *Attorney, Agent, or Firm*—Roylance, Abrams, Berdo & Goodman, L.L.P.

(57) ABSTRACT

A paper guide device which guides a sheet of paper fed to a nip between an image belt and a transfer roller and an image forming apparatus including the same. The paper guide device includes a first convey guiding unit arranged within a predetermined space from an image belt to firstly guiding the paper to a nip between the image belt and a transfer roller. A second convey guiding unit is arranged on the first convey guiding unit to contact the image belt to secondly guide the paper to the nip without contacting the image belt. The device accurately guides the paper to the nip without contacting the image transfer belt.

10 Claims, 8 Drawing Sheets

PAPER GUIDE DEVICE AND IMAGE FORMING APPARATUS HAVING THE SAME

CROSS-REFERENCE TO RELATED APPLICATIONS

This application claims the benefit of Korean Patent Application No. 2004-82609, filed on Oct. 15, 2004, the entire disclosure of which is hereby incorporated by reference.

BACKGROUND OF THE INVENTION

1. Field of the Invention

The present invention relates to an image forming apparatus. More particularly, the present invention relates to a paper guide device for guiding paper fed to a nip, between an image belt and a transfer roller, and an image forming apparatus including the same.

2. Description of the Related Art

Generally, an image forming apparatus such as an electrophotographic printer forms images on a recording medium, such as sheets of paper, by forming an electrostatic latent image on a photoconductor. The photoconductor may be an organic photoconductive (OPC) drum or a photoconductive belt for developing the formed electrostatic latent image by using a developer having a predetermined color and transferring the developed image to the recording medium. The electro-photographic printer is classified as a wet type or a dry type according to the type of developer being used. In the wet type printer, a liquid developer is used for developing electrostatic latent images formed on the photoconductor. The liquid developer is a mixture of a liquid carrier and a powder type of a toner.

FIG. 1 is a diagram illustrating a conventional wet type color electro-photographic printer.

As shown in FIG. 1, the conventional wet type color electro-photographic printer 1 includes an image forming unit 5, a transfer belt unit 10, a convey guiding unit 40, a fixing unit 21, a paper discharging unit 30 and a cleaning unit 50.

Each image forming unit 5 includes a laser scanning unit 11, a charge roller 12, a photoconductor 9 and a developing device 13 for forming an image with colors typically including black, yellow, cyan and magenta.

Each of the developing devices 13 includes a developer storage unit 6, a developing roller 7, a deposit roller 14, a metering roller 15 and a cleaning roller 16. The developer storage unit 6 stores a liquid developer 48. The developing roller 7 is arranged below the photoconductor 9. The deposit roller 14 is arranged below the developing roller 7. The deposit roller 14 forms a developer layer on the developing roller 7 by supplying electrical power to the liquid developer 48. The metering roller 15 provides a predetermined voltage to the developer layer on the developing roller 7 and controls the developer layer to maintain a constant amount of toner or constant concentration (solid %). After controlling, the metering roller 15 provides the controlled developer layer to a nip between the developing roller 7 and the photoconductor 9. The cleaning roller 16 cleans the developing roller 7.

The deposit roller 14 and the metering roller 15 supply the developing layer, having a constant amount of toner or constant concentration, to the nip between the developing roller 7 and the photoconductor 9. This is done regardless of the concentration of 30-40 solid % of high concentration liquid developer, or liquid developer 48 which varies during use of the liquid developer 48.

Each of photoconductors 9 is formed of an organic photoconductive (OPC) drum. Different colors of toner images are formed on the photoconductors 9 by corresponding developing devices 13.

The transfer belt unit 10 includes a first transfer roller 8, a second transfer roller 23 and an image transfer belt 17. The image transfer belt 17 rotates along a path of a caterpillar track made by a first, a second and a third supporting rollers 19, 20 and 21. The first transfer roller 8 overlappingly transfers toner images formed on the photoconductors 9 to the image transfer belt 17. The second transfer roller 23 transfers the toner images formed on the image transfer belt 17 to sheets of paper P.

A paper guide unit 35 includes a convey guiding unit 40 for guiding paper to a nip between the image transfer belt 17 and the second transfer roller 23. The paper is fed to the transfer belt unit 10 by a convey roller (not shown) of a paper feeding unit (not shown). The convey guiding unit 40 is fixed to a fixing bracket 44 of a movable frame (not shown) for supporting a shaft 23*a* of the second transfer roller 23, as shown in FIG. 2.

Also as shown in FIG. 2, the convey guiding unit 40 includes a first guide plate 43 and a second guide plate 41. The first guide plate 43 guides a back side of the paper, where none of the images are formed, and is fixed to the fixing bracket 44. The second guide plate 41 guides a front side of the paper, where images are formed, and is fixed to the first guide plate 43. The second guide plate 41 is arranged within a predetermined space from side guide plate 45. The side guide plate 45 is arranged on both sides of the first guide plate 43 and formed on the fixing bracket 44.

The fixing unit 21 includes first and second heating rollers 25 and 27, and first and second pressuring rollers 26 and 28. The first and the second heating rollers 25 and 27 provide heat to the transferred toner image on the paper P. The first and second pressuring rollers 26 and 28 pressurize the paper P with a constant pressure. The heated and pressurized paper P, with the toner image, is discharged to the exterior of the unit by first and second paper feeding roller 31 and 32. First and second paper feeding backup rollers 33 and 34 are also arranged in the paper discharging unit 30.

The cleaning unit 50 includes a cleaning blade 51 for removing used developer remaining on the image transfer belt 17 after transferring the toner image on the paper P and a used developer storage 52 for storing the removed developer.

Hereinafter, operations of the conventional wet type color electro-photographic printer 1 are explained in detail.

When the conventional wet type color electro photographic printer 1 receives a printing command, the image forming unit 5 performs an image forming operation for forming images with four colors.

That is, an electrostatic latent image is formed on each of photoconductors 9 by using the charge roller 12 and the laser scanning unit 11. After forming the electrostatic latent images, the deposit roller 14 and the metering roller 15 form a toner image by attaching toner of a developer layer to the electrostatic latent image on the photoconductor 9 by using the liquid developer 48 stored in the storing unit 6.

The liquid developer 48 is formed as a charged developer layer on the developing roller 17 by electric power from the deposit roller 14. The metering roller 15 supplies a predetermined voltage to the charged developer layer and regulates it to have a constant amount of toner.

The toner images formed on the photoconductors 9 are overlappingly transferred to the image transfer belt 17 by voltage and pressure from the first transfer roller 8. After transferring the toner images on the image transfer belt 17, a belt operating roller 22 rotates the image transfer belt 17 along the first, the second and the third supporting rollers 19, 20, 21 for moving the image transfer belt 17 to the second transfer roller 23. When the image transfer belt 17 reaches the second transfer roller 23, the overlapped toner image formed on the image transfer belt 17 is transferred to the paper P by voltage and pressure from the second transfer roller 23. The paper P is conveyed from the paper feeding unit to the transfer belt unit 10 through the convey guiding unit 40.

The toner image-transferred paper is heated and pressurized by the first and the second heating rollers 25 and 27, and the first and the second pressuring roller 26 and 28.

After firmly fixing the overlapped toner image onto the paper P, the paper P is discharged from the printer by the first and the second paper discharging rollers 31 and 32, and the first and second paper discharging backup rollers 33 and 34 in the paper discharging unit 30.

After transferring the overlapped toner image on the paper P, the image transferring belt is continuously rotated and moved to the cleaning blade 51. The cleaning blade 41 removes developer remaining on a surface of the image transfer belt 17 and the used developer storage unit 52 collects the removed developer. Generally, during transferring, 90-98% of developer is transferred from the image transfer belt 17 to the paper and 2-10% of developer remains on the image transfer belt 17 without being transferred thereto.

After removing the remaining developer, the above mentioned operations are repeatedly performed for forming another image onto the paper.

The conventional wet type color electro photographic printer 1 guides the paper P to the nip between the image transfer belt 17 and the second transfer roller 23. This is accomplished by using the convey guiding unit 40 when the paper is fed to the transfer belt unit 10 for transferring the toner image formed on the image transfer belt 17 to the paper P.

However, the paper P is not directly fed to the nip between the image transfer belt 17 and the second transfer roller 23. As shown in FIG. 2, first an upper edge of the paper P is guided to a surface of the image transfer belt 17. That is, the upper edge of the paper directly contacts an image forming surface of the image transfer belt 17 before the paper P is fed to the nip. Accordingly, the image forming surface of the image transfer belt 17 is impacted by a shock from the upper edge of the paper when the paper contacts to the image transfer belt 17.

As a result, since the image transfer belt 17 is generally manufactured by a gummous material, a number of scratches are formed on the image forming surface of the image transfer belt 17, due to the impact of the upper edge of the paper. Accordingly, the quality of the toner image transferred from the image transfer belt to the paper P degrades.

The first and the second guide plates 43 and 41 are spaced apart from the image transfer belt 17 because the image transfer belt 17 vibrates when the image transfer belt 17 is rotated by the belt operating roller 22.

Accordingly, the upper edge of the paper P is not completely guided to the nip when the paper is fed to the transfer belt unit 10 through the first and the second guide plates 43 and 41. Therefore, the paper P often curls at an entrance of the nip and frequently causes paper jams.

Therefore, there have been many attempts to develop a paper guide device for preventing the image transfer belt 17 from being damaged by the upper edge of the paper P and preventing paper jams from being generated between the image transfer belt 17 and the second transfer roller 23 when the paper is fed to the transfer belt unit 10.

Accordingly, there is a need for an improved paper guide device for accurately guiding sheet of paper to a nip between an image transfer belt and a transfer roller while preventing damage to the image transfer belt.

SUMMARY OF THE INVENTION

An aspect of the present invention is to solve at least the above problems and/or disadvantages and to provide at least the advantages described below. Accordingly, an aspect of the present invention is to provide a paper guide device for accurately guiding sheets of paper to a nip between an image transfer belt and a transfer roller without damaging the image transfer belt.

In accordance with an aspect of the present invention, there is provided a paper guide device in an image forming apparatus which includes a first convey guiding unit spaced apart from an image belt to firstly guiding a sheet of paper to a nip between the image belt and a transfer roller. A second convey guiding unit is arranged on the first convey guiding unit to contact the image belt to secondly guiding the paper to the nip without contacting the image belt.

The second convey guiding unit may include a guiding member which is rotatably arranged on the first convey guiding unit to guide the paper. An absorbing member is arranged on the guiding member to contact the image belt to prevent the guiding member from directly contacting the image belt. An elastic member elastically pressurizes the guiding member to allow the absorbing member to contact the image belt.

The guide member may include a convey guiding plate. The absorbing member may include at least one contacting roller arranged on the convey guiding plate. The elastic member may include a torsion spring disposed on a rotating axis of the convey guiding plate. The torsion spring has one end supported by the convey guiding plate and another end supported by the first convey guiding unit.

The image belt may include at least one photoconductive belt having a photoconductor to form a toner image and an image transfer belt which transfers the toner image on the paper from the photoconductor.

In accordance with another aspect of the present invention, there is provided an image forming apparatus including an image forming unit including a photoconductor which forms a toner image. A transfer belt unit includes an image transfer belt and a transfer roller which transfers the toner image formed on the photoconductor to a sheet of paper. A paper guiding unit guides the paper to the transfer belt unit. A fixing unit fixes the toner image transferred on the paper and a paper discharging unit discharges the paper with the toner image. The paper guiding unit is arranged within a predetermined space from the image transfer belt and includes a first convey guiding unit spaced apart from an image belt to firstly guide a sheet of paper to a nip between the image belt and a transfer roller. A second convey guiding unit arranged on the first convey guiding unit contacts the image belt to secondly guiding the paper to the nip without contacting the image belt.

The second guiding unit may include a guiding member rotatably arranged on the first convey guiding unit which guides the paper. An absorbing member is arranged on the guiding member to contact the image belt to prevent the guiding member from directly contacting the image belt. An elastic member elastically pressurizes the guiding member to allow the absorbing member to contact the image belt.

The guide member may include a convey guiding plate which is longer in the longitudinal direction. The absorbing member may include at least one contacting roller arranged on the convey guiding plate and the elastic member may include a torsion spring disposed on a rotating axis of the convey guiding plate. The torsion spring has one end supported by the convey guiding plate and another end supported by the first convey guiding unit.

In accordance with still another aspect of the present invention, there is provided an image forming apparatus including an image forming unit including a photoconductive belt which forms a toner image. A transfer unit includes a transfer roller to transfer the toner image formed on the photoconductive belt. A paper guiding unit guides a sheet of paper to the transfer unit. A fixing unit fixes the toner image transferred on the paper. A paper discharging unit discharges the paper with the toner image. The paper guiding unit is arranged within a predetermined space from the photoconductive belt and includes a first convey guiding unit spaced apart from an image belt to firstly guide a sheet of paper to a nip between the image belt and a transfer roller. A second convey guiding unit is arranged on the first convey guiding unit to contact the image belt to secondly guide the paper to the nip without contacting the image belt.

The second guiding unit may include a guiding member which is rotatably arranged on the first convey guiding unit to guide the paper. An absorbing member is arranged on the guiding member to contact the image belt to prevent the guiding member from directly contacting the image belt. An elastic member elastically pressurizes the guiding member to allow the absorbing member to contact the image belt.

The guide member may include a convey guiding plate which is longer in the longitudinal direction. The absorbing member may include at least one of contacting roller arranged on the convey guiding plate. The elastic member may include a torsion spring disposed on a rotating axis of the convey guiding plate. The torsion spring has one end supported by the convey guiding plate and another end supported by the first convey guiding unit.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 3:
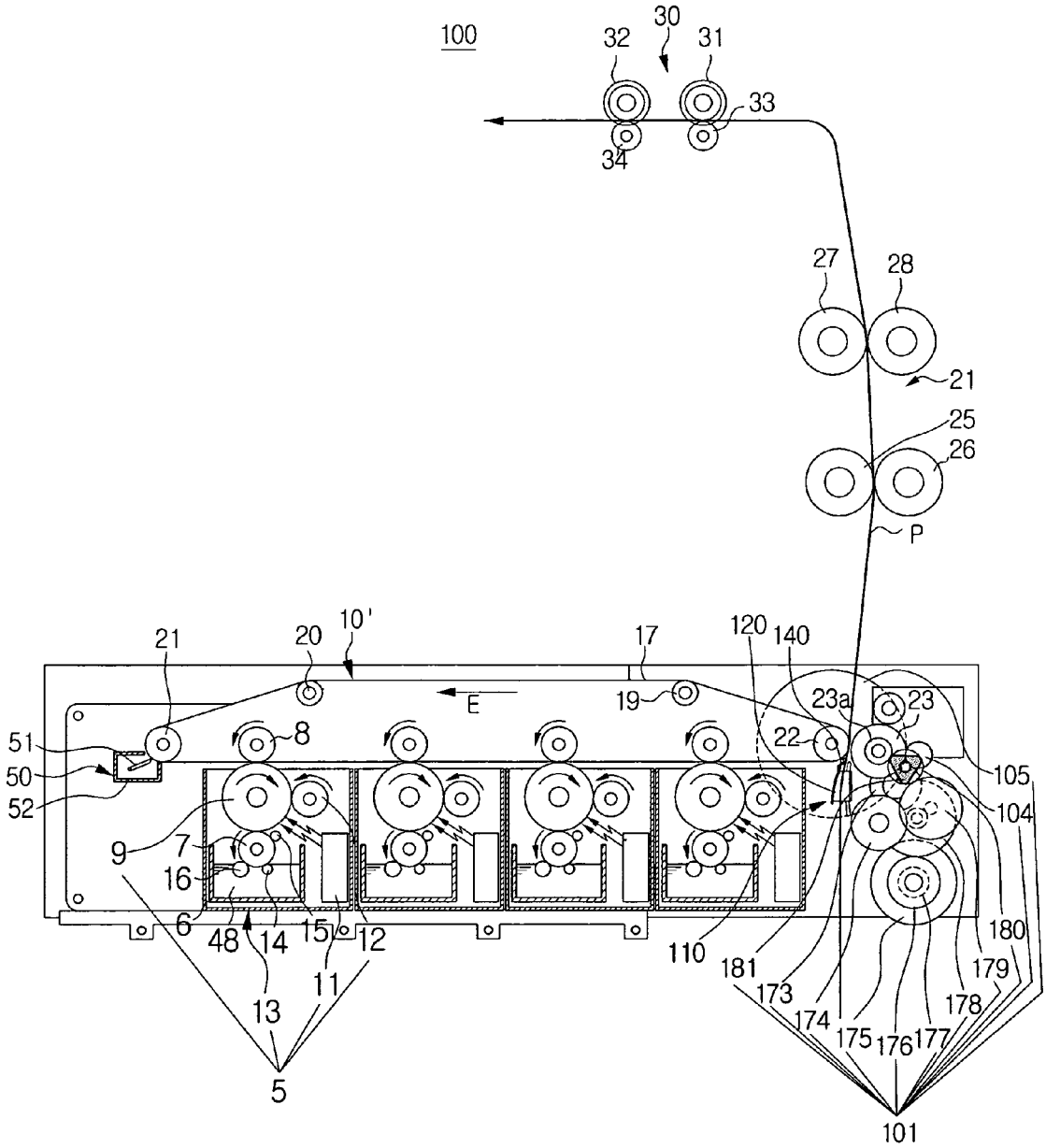
FIG. 3 is a diagram of a wet type color electro photographic printer including a paper guide unit in accordance with an exemplary embodiment of the present invention.

FIG. 3 is a diagram of an image forming apparatus including a paper guide unit in accordance with a preferred embodiment of the present invention.

The image forming apparatus includes a paper guide device preferably for a wet type color electro photographic printer 100. The wet type color electro photographic printer 100 receives printing data transmitted from a computer (not shown) and performs a printing operation by internally processing the received printing data.

As shown in FIG. 3, the wet type color electro photographic printer 100 includes a paper feeding unit (not shown) for feeding paper P stored in a paper feeding cassette (not shown), an image forming unit 5 having four photoconductors 9, a transfer belt unit 10' for orderly transferring a toner image formed on each of the photoconductors 9 to the paper P, a paper guiding unit 110 for guiding the paper to the transfer belt unit 10', a fixing unit 21 for fixing toner image transferred to the paper and a paper discharging unit 30 for discharging the paper from the printer 100.

Figure 1:
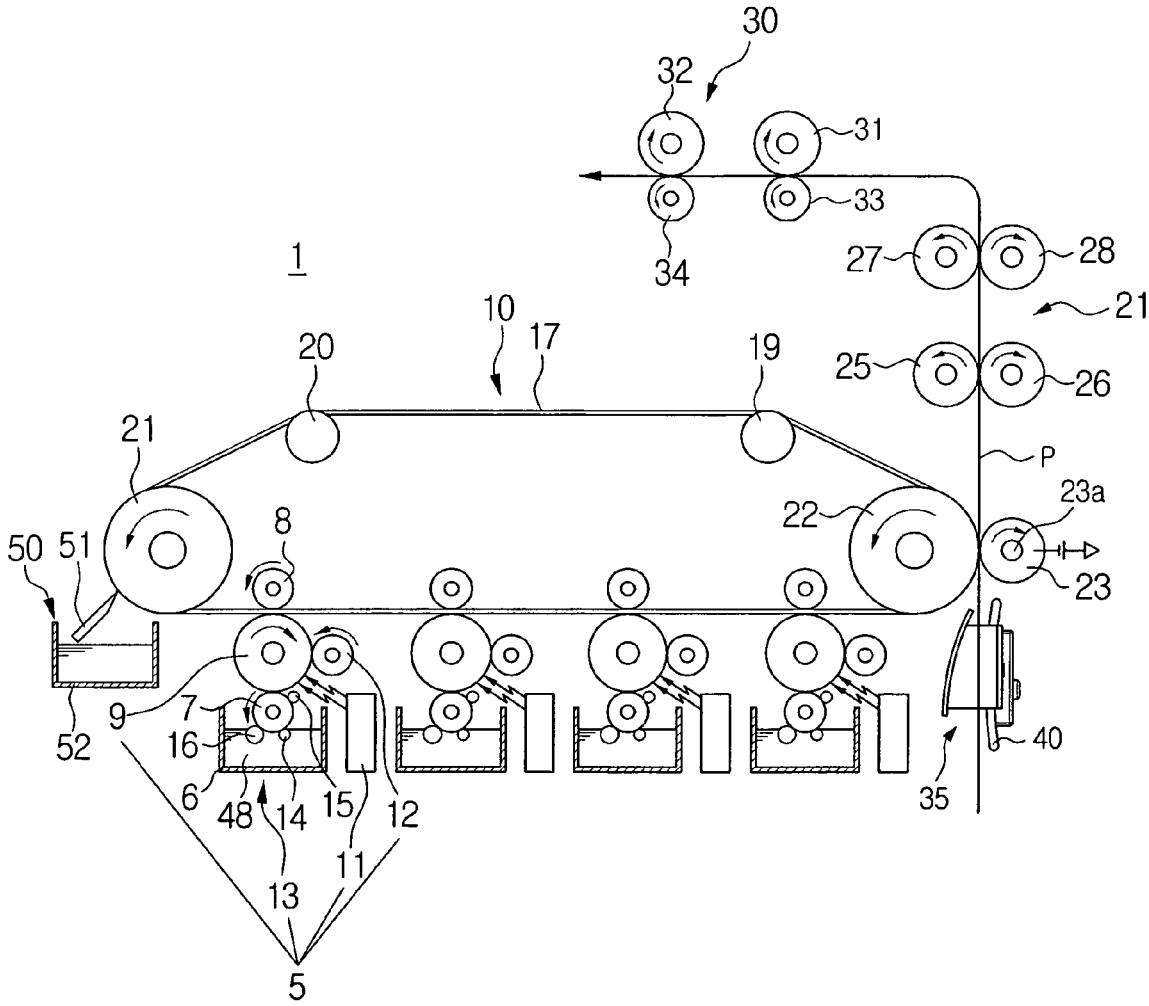
FIG. 1 (PRIOR ART)
FIG. 1 is a diagram of a conventional wet type color electro photographic printer.
Figure 2:
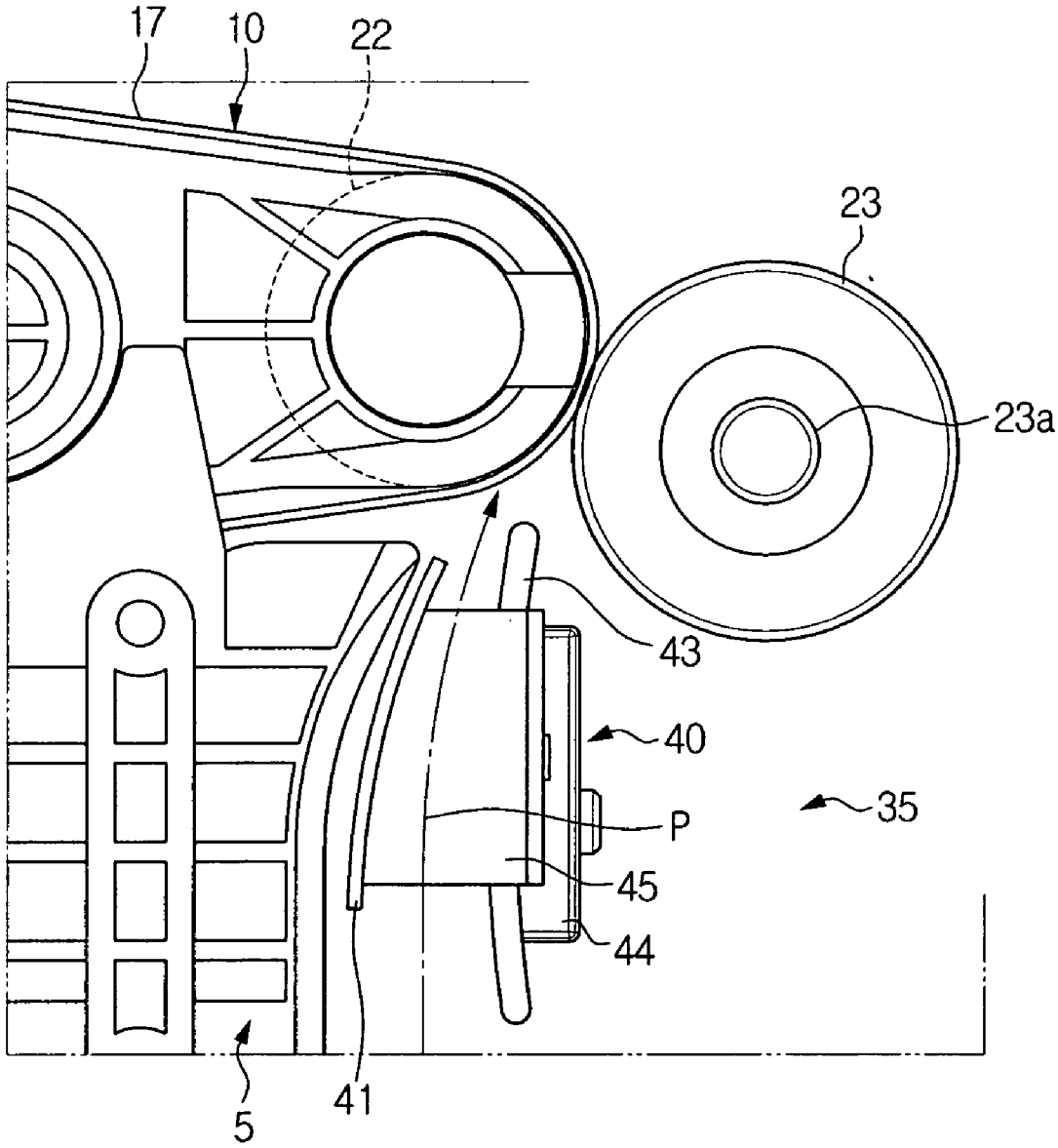
FIG. 2 (PRIOR ART)
FIG. 2 is a detailed diagram of a paper guide unit of a conventional wet type color electro photographic printer of FIG. 1.

Constructions and operations of the wet type color electro photographic printer 100 are identical to the conventional wet type color electro photographic printer 1 shown in FIGS. 1 and 2 except for the transfer belt unit 10' and the paper guiding unit 110. Therefore, detailed explanation of well-known functions and constructions of the wet type color electro photographic printer 100 are omitted for clarity and conciseness.

The transfer belt unit 10' includes first transfer rollers 8, a second transfer roller 23, an image transfer belt 17 and a transfer belt operating unit 101.

A belt operating roller 22 rotates the image transfer belt 17 along a path of a caterpillar track made by a first, a second and a third supporting rollers 19, 20 and 21.

The first transfer rollers 8 transfer toner images formed on the photoconductors 9 to the image transfer belt 17 and the second transfer roller 23 transfers the overlapped toner images on the image transfer belt 17 to a paper P.

The transfer belt operating unit 101 operates the transfer belt unit 10' and includes an operating motor (not shown) for the transfer belt unit 10', a belt operating gear 105, a reduction gear for a clutch reduction gear 173, a first idler gear 174, a first clutch gear 175, a clutch 177, a second clutch gear 176, a first reduction gear 178, a second reduction gear 179, a cam operating gear 180, and a cam 181.

The belt operating gear 105 is connected to one end of an operating gear 104 of the motor. The belt operating gear 105 transfers the power of the motor to the image transfer belt through the belt operating roller 22. That is, the power of the motor rotates the image transfer belt 17 along the first, the second and the third supporting roller 19, 20 and 21 in a predetermined direction e.g., a direction of an arrow E shown in FIG. 3.

The reduction gear 173 is coupled to other end of the operating gear 104 and is connected to the first clutch gear 175 through the first idler gear 174 for transferring the power of the motor to the first clutch gear 175. The power transferred to the first clutch gear 175 is transferred to the second clutch gear 176 or is intercepted.

The clutch 177 transfers the power of the motor to the second clutch gear 176 when the second transfer roller 23 contacts the image transfer belt 17 for transferring the overlapped toner images formed on the image transfer belt 17 to the paper P or when the second transfer roller 23 separates from the image transfer belt 17 after the printing has finished. The power transferred to the second clutch gear 176 is transferred to the cam operating gear 180 through the first reduction gear 178 and the second reduction gear 179.

The cam 181 is formed on an axis where the cam operating gear 180 is formed. That is, the cam 182 rotates when the cam operating gear 180 rotates. The cam 181 has a triangle shape having three planar sides and three flattened corners between the planar sides. When the cam 181 is rotated by the cam operating gear 180, the planar sides and the flattened corners of the cam 181 retract or push a shaft 23*a* of the second transfer roller 23. Accordingly, the second transfer roller 23 contacts the image transfer belt 17 or separates from the image transfer belt.

Figure 7:
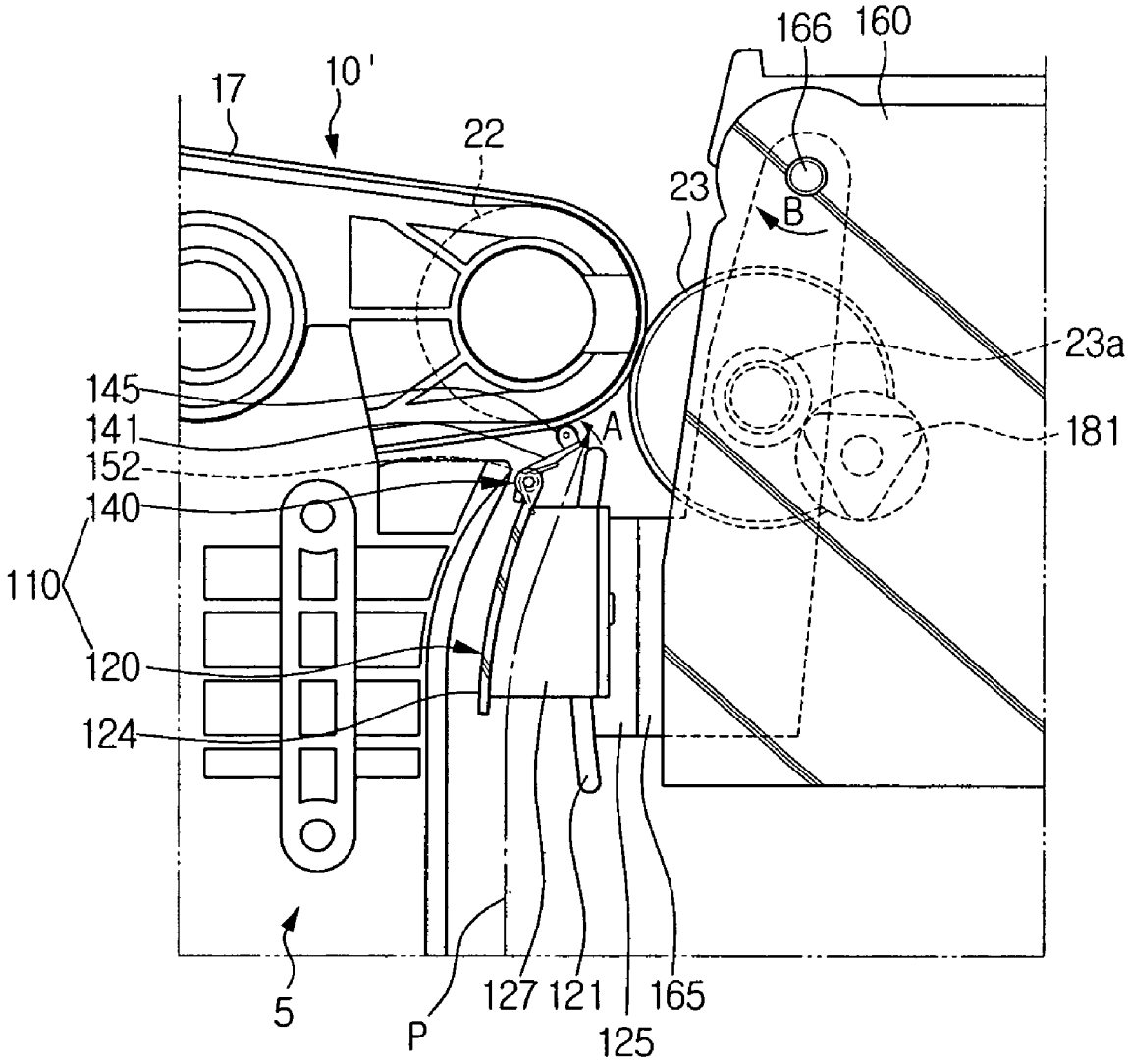
FIGS. 7 and 8 are partial side elevation views exemplifying the operation of the paper guide unit of the wet type color electro photographic printer of FIG. 3.
Figure 8:
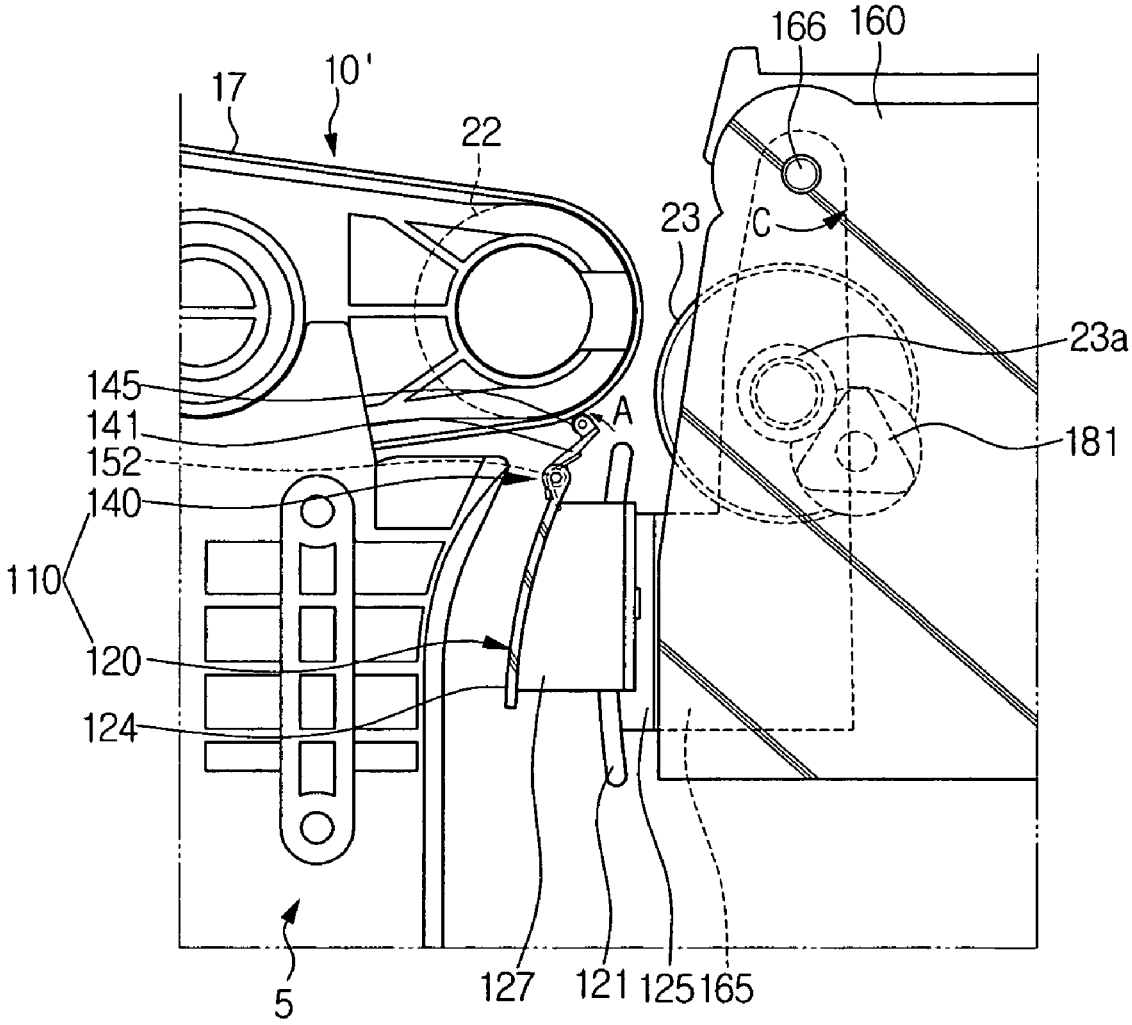

As shown in FIGS. 7 and 8, the shaft 23*a* of the second transfer roller 23 is rotatably supported by the movable frame 165 supporting the first convey guiding unit 120 of the paper guiding unit 110. The movable frame 165 is rotatably supported and rotates about a rotating axis 166 of a supporting frame 160 in a clockwise direction or a counter clockwise direction. Also, the movable frame 165 is elastically pressurized by an elastic spring (not shown) arranged on the supporting frame 160 for contacting the shaft 23*a* to the cam 181. Accordingly, when the cam 181 retracts or pushes the shaft 23*a* for contacting or separating the second transfer roller 23 to or from the image transfer belt 17, the movable frame 165 rotates with the second transfer roller 23 in directions B and C as shown in FIGS. 7 and 8. That is, the movable frame 165 moves closer to the image transfer belt 17 or away from the image transfer belt 17.

Figure 4:
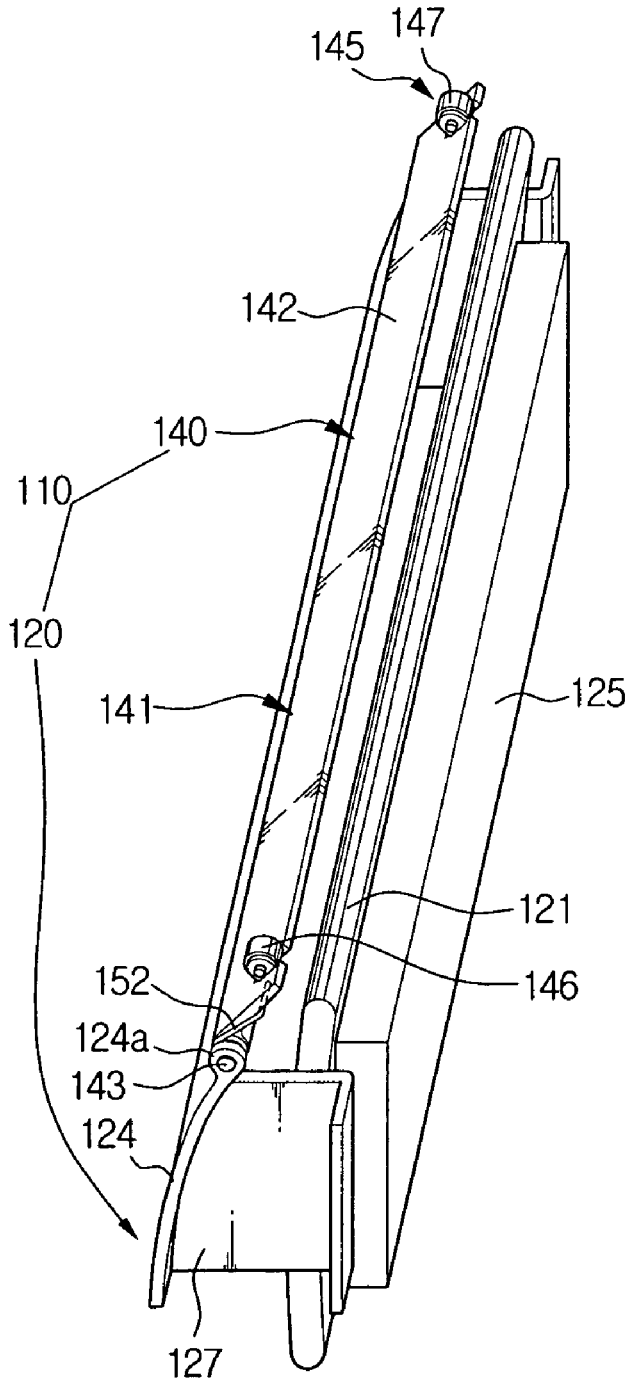
FIG. 4 is detailed diagram of the paper guide unit of the wet type color electro photographic printer of FIG. 3.

The second transfer roller 23 moves the paper P to the fixing unit 21 via rotation with the image transfer belt 17 when the second transfer roller 23 contacts the transfer belt roller 22 by rotation of the cam 181 and the belt operating roller 22 rotates the image transfer belt 17 in the direction E (FIG. 4).

The paper guide unit 110 includes a first convey guiding unit 120 and a second convey guiding unit 140.

As shown in FIGS. 7 and 8, the first convey guiding unit 120 firstly guides the paper P to a nip between the image transfer belt 17 and the second transfer roller 23 for forming a toner image on the paper P which moves to the paper guide unit 110 by a feeding roller (not shown) of the paper feeding unit. The first convey guiding unit 120 is arranged on the movable frame 165 to maintain a predetermined space with the image transfer belt 17.

As shown in FIG. 4, the first convey guiding unit 120 includes a first guide plate 121 and a second guide plate 124. The first guide plate 121 guides a back side of the paper P where the image is not formed and is fixed to a fixing bracket 125 of the movable frame 165. The second guide plate 124 guides a front side of the paper P where the image is formed and is fixed to the first guide plate 121. The second guide plate 124 is spaced apart from the first guide plate 121 by side guide plates 127 arranged on both sides of the first guide plate 121 and is formed on the fixing bracket 125.

The first convey guide unit 121 moves to a forwarding position (FIG. 7) which is a position closer to the image transfer belt 17 or to a backward position (FIG. 8) which is a position farther away from the image transfer belt 17 by the movable frame 165. That is, according to the rotation of the cam operating gear 150, when the cam 181 pushes the shaft 23*a* of the second transfer roller 23 for contacting the second transfer roller 23 to the image transfer belt 17, the first convey guiding unit 120 moves to the forward position by the movable frame 165 which rotates to the direction of B shown in FIG. 7. Also, the first convey guiding unit 120 moves to the backward position by the movable frame 165 which is rotated to a direction of C in FIG. 8 when the cam 181 retracts the shaft 23*a* of the second transfer roller 23 to separate the second transfer roller 23 from the image transfer belt 17. When the first convey guiding unit 120 is in the forward position, the first convey guiding unit 120 guides paper P to the nip between the image transfer belt 17 and the second transfer roller 23.

The second convey guiding unit 140 secondly guides the paper which is firstly guided to the nip by the first convey guiding-unit 120 and is arranged on the first convey guiding unit 120 to contact the image transfer belt 17.

Figure 5:
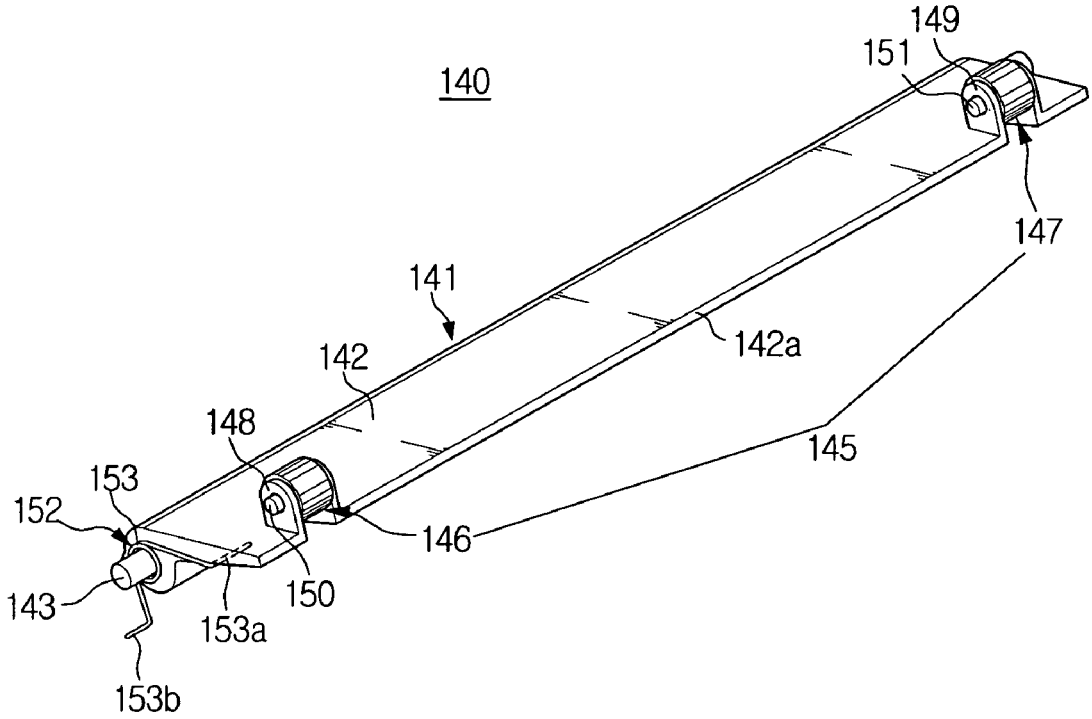
FIG. 5 is a perspective view of a second convey guiding unit of the paper guide unit of FIG. 4.
Figure 6:
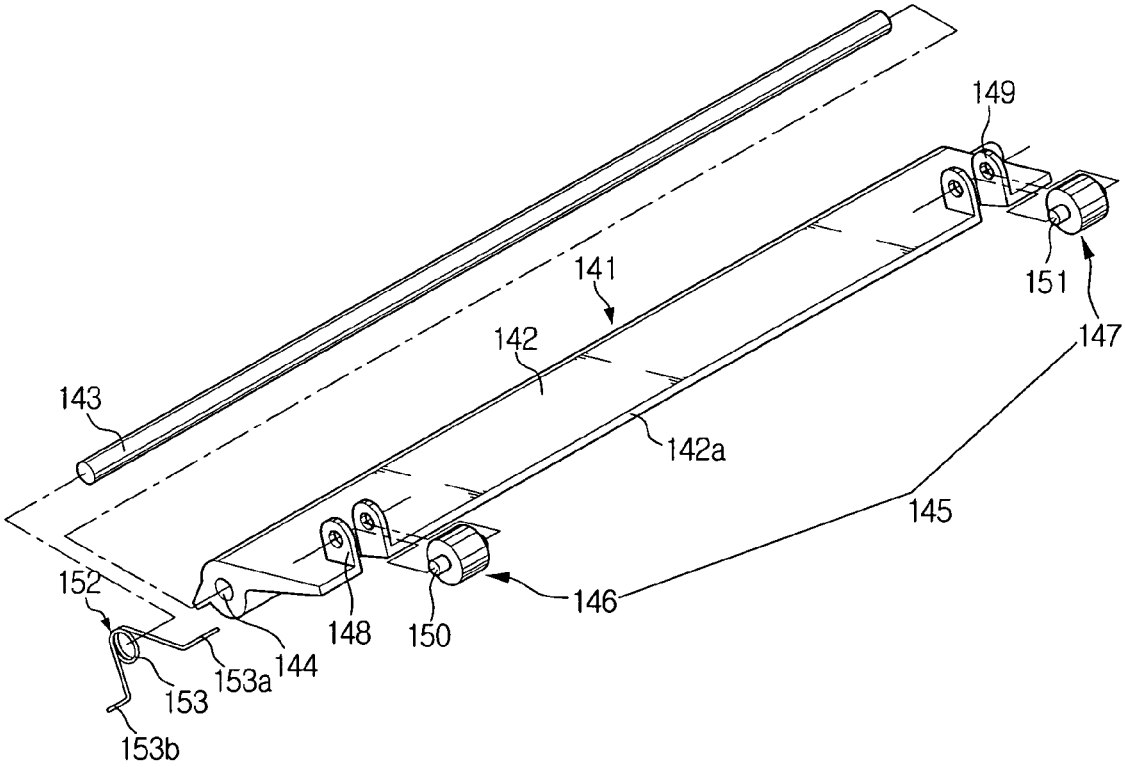
FIG. 6 is a perspective view of a second convey guiding unit of the paper guide unit of FIG. 5.

As shown in FIGS. 5 and 6, the second convey guiding unit 140 includes a guiding member 141, an absorbing member 145 and an elastic member 152.

The guiding member 141 includes a convey guide plate 142 which is preferably longer in the longitudinal direction. The convey guide plate 142 is rotatably coupled to a downstream end 124*a* in a paper convey direction of the second guide plate 124. The convey guide plate 142 includes an axis supporting hole 144 for housing and supporting the rotating axis 143. Both ends of the rotating axis 143 are supported at the downstream end 124*a* of the second guide plate 124.

The absorbing member 145 absorbs a shock generated by contacting the convey guide plate 142 of the guide member 141 to the image transfer belt 17. That is, the absorbing member 145 prevents direct contact to the image transfer belt 17 made by the convey guide plate 142. The absorbing member 145 includes first and second contact rollers 146 and 147 formed at a downstream end 142*a* in the paper convey direction of the convey guide plate 142 to contact with the image transfer belt 17.

The first and the second contact rollers 146 and 147 are arranged in a spaced-apart relationship with each other at the downstream end 142*a* of the convey guide plate 142 for preventing the toner image formed on the image forming surface of the image transfer belt 17 from being damaged. The spaced distance between the first and the second contact roller 146 and 147 may be wider than a size of a letter which is typically about 216 mm.

The first and the second contact rollers 146 and 147 are rotatably arranged on the first and the second supporting brackets 148 and 149 by the first and the second supporting axis 150 and 151. The first and the second supporting brackets 148 and 149 are arranged in a spaced-apart relationship corresponding to the first and the second contact rollers 146 and 147 at the downstream end 142*a* of the transfer guide plate 142. The first and the second supporting brackets 148 and 149 project toward the image transfer belt 17.

In the exemplary embodiment of the present invention, the absorbing member 145 includes the first and the second contact rollers 146 and 147. However, the absorbing member 145 may include one contact roller disposed at the downstream end 142*a* of the transfer guide plate 142. The number of absorbing member may vary according to a design of the paper guide device.

The elastic member 152 includes a torsion spring 153 arranged on the rotating axis 143 of the convey guide plate 153. The torsion spring 153 has one end 153*a* supported by the convey guide plate 142 and another end 153*b* is supported by the downstream end 124*a* in a paper convey direction of the second guide plate 124 of the first convey guide unit 120. An elastic force of the torsion spring 153 acts to pressurize the transfer guide plate 142 of the guide member 141 to contact the first and the second contact rollers 146 and 147 with the image transfer belt 17. That is, the elastic force of the torsion spring 153 acts to push the guide member 141 in a direction A shown in FIGS. 7 and 8.

The convey guide plate 142 moves between a guiding position shown in FIG. 7 and a waiting position shown in FIG. 8 by the torsion spring 153 according to a position of the first guide unit 120. That is, when the first convey guiding unit 120 moves to the forwarding position, the transfer guide plate 142 moves to the guiding position by rotating about the rotating axis 143 in a direction to the second transfer roller 23 against the elastic force of the torsion spring as shown in FIG. 7. When the first convey guiding unit 120 moves to the backward position, the convey guide plate 142 moves to the waiting position by rotating about the rotating axis 143 in a direction toward the image transfer belt 17 via the elastic force of the torsion spring 153 as shown in FIG. 8.

When the convey guide plate 142 is in the guide position, it allows the paper P to be correctly guided to the nip between the image transfer belt 17 and the transfer roller 23 without contacting the image transfer belt 17. Accordingly, the image transfer belt 17 is not impacted directly by the paper P and therefore the image transfer belt 17 is not damaged. Also, the paper P is fed to the nip without being curled because the paper P is accurately guided to a position very close to the nip. Therefore, paper jams are also prevented.

In the above mentioned exemplary embodiments of the present invention, the paper guide device guides the paper P to the nip without contacting with the image transfer belt 17 in the wet type color electro photographic printer 100 having the transfer belt unit 10' with the image transfer belt 17. However, the exemplary embodiment of the present invention is not limited as applied to the wet type color electro photographic printer. The paper guide device may be implemented to other types of printers. For example, the paper guide device may be implemented to a printer using the image transferring belt 17 as the photoconductor 9 and including a transferring unit which directly transfers a toner image from a photoconductive belt to the paper P. Moreover, the paper guide device may be implemented to a transfer or fixing unit that directly transfers a toner image from a photoconductive belt to a paper P and fixes the transferred image on the paper P without including the transfer belt unit 10.

Hereinafter, operations of a wet color electro photographic printer 100 including the transferring unit with the paper guide unit 110 are explained by referring FIGS. 3 through 8.

When the printer 100 receives a printing command, an operating motor for a transfer belt unit 100 is operated. The operating power of the operating motor is transferred to an image transfer belt 17 through a belt operating gear 105 and a belt operating roller 22 connected to the operating gear 104 of the operating motor. That is, the belt operating roller 22 rotates the image transfer belt 17 along a first, a second and a third supporting roller 19, 20, 21 in a direction of E in FIG. 3.

An image forming unit 5 is operated identically to the conventional printer 10 explained by referring to FIGS. 1 and 2. That is, a toner image is formed on each of photoconductors 9 and the toner image is formed on the photoconductors 9 and is overlappingly transferred to the image transfer belt 17 by voltage and pressure from the first transfer rollers 8 arranged on the image transfer belt 17.

A paper P in the paper feeding cassette (not shown) is fed to a transfer belt unit 10' by a pickup roller (not shown) and a convey roller (not shown) of the paper feeding unit.

A clutch 177 of a transfer belt operating unit 101 is turned on and an operating power of the motor is transferred to a second clutch gear 176 through a clutch reduction gear 173, a first idler gear 174 and a first clutch gear 175. As a result, the power transferred to the second clutch gear 176 is transferred to a cam operating gear 180 through the first reduction gear 178 and the second reduction gear 179. One of three flattened corners of the cam 181 pushes the shaft 23*a* of the second transfer gear 23 for contacting the second transfer roller 23 to the image transfer belt 17 according to rotation of the cam operating gear 180. After the second transfer roller 23 contacts the image transfer belt 17, the clutch 177 is turned off and thereby the power of the motor is not transferred to the second clutch gear 176 through the first clutch gear 175, but intercepted.

A movable frame 165 moves to a direction of B in FIG. 7 by rotation of the cam 181 and a first convey guiding unit 120 moves with the movable frame 165. That is, the first convey guiding unit 120 moves from a backward position as shown in FIG. 8 to a forward position as shown in FIG. 7. As the first convey guiding unit 120 moves to the forward position, the convey guide plate 142 rotates about a rotating axis 143 via the image transfer belt 17 and is moved from the waiting position to the guiding position. That is, the convey guide plate 142 is moved from the waiting position to the guiding position by being rotated against the elastic force of the torsion spring 153.

After the convey guide plate 142 moves to the guiding position, the convey guide plate 142 contacts an upper edge of the paper P which is firstly guided for feeding to a nip between the image transferring belt 17 and the second transfer roller 23. As a result, the paper P is secondly guided to the nip without contacting the image transfer belt 17. Accordingly, the image transfer belt 17 is not directly impacted by the paper P and also the paper P is fed to the nip without generating a curl.

The image transfer belt 17 rotates in a direction of E in FIG. 3 and moves to the second transfer roller 23. When the toner image formed on the image transfer belt 17 reaches the second transfer roller 23, the toner images overlap on the image transfer belt 17 and are transferred to the paper P by voltage and pressure from the second transfer roller 23.

Then, the overlapped toner image is transferred to the paper P and fixed by first and second heating rollers 25 and 27 and first and second pressurizing rollers 26 and 28 for forming a desired image on the paper P.

After forming the desired image on the paper P, the paper P is discharged from the printer 100 by first and second paper discharging rollers 31 and 32 and first and second paper discharging backup rollers 33 and 34 of the paper discharging unit 30.

After the overlapped toner image is transmitted to the paper P, developer remaining on the image transfer belt 17 is cleaned and removed by a cleaning blade as the image transfer belt 17 rotates. The above mentioned operations are repeatedly performed for forming another image on the paper.

After completion of printing operations, the clutch 177 of the transfer belt operating unit 101 is turned on again and the power of the motor is transferred to the second clutch gear 176 through the clutch reduction gear 173. That is the first idler gear 174 and the first clutch gear 175. The power transferred to the second clutch gear 176 is transferred to the cam operating gear 180 through the first reduction gear 178 and the second reduction gear 179. The cam 181 is rotated by the cam operating gear 179. One of the planar sides of the cam 181 contacts the shaft 23*a* of the second transfer roller 23 for retracting the shaft 23*a*. The second transfer roller 23 separates from the image transfer belt 17 by retracting the shaft 23*a*. After retracting the shaft 23*a*, the clutch 177 is turned off and thereby the power of the motor is not transferred to the second clutch gear 176 through the first clutch gear 175.

Consequently, the first convey guiding unit 120 moves from the forwarding position shown in FIG. 7 to the backward position shown in FIG. 8 by rotating the movable frame 165 to the direction C in FIG. 8. Now, the movable frame is rotated by rotation of the cam 181. As the the first convey guiding unit 120 is moved to the backward position, the convey guide plate 142 moves to the waiting position from the guiding position by the elastic force of the torsion spring 153.

Then, the motor is stopped and printing operations are complete.

As mentioned above, the image forming apparatus including the paper guide device of exemplary embodiments of the present invention accurately guides the paper to the nip between the image transfer belt and the transfer roller without contacting the image transfer belt via the first and the second convey guiding units. Accordingly, the image transfer belt is not damaged by the paper and the paper does not curl upon entrance of the nip. Therefore, the image forming apparatus including the paper guide device prevents damage of the image transfer belt and paper jam.

While the invention has been shown and described with reference to certain embodiments thereof, it will be understood by those skilled in the art that various changes in form and details may be made therein without departing from the spirit and scope of the exemplary embodiments of the invention as defined by the appended claims.

What is claimed is:

1. A paper guide device in an image forming apparatus, comprising:

a first convey guiding unit spaced apart from an image belt to firstly guide a sheet of paper to a nip between the image belt and a transfer roller; and a second convey guiding unit arranged on the first convey guiding unit which contacts the image belt for secondly guiding the paper to the nip without contacting the image belt.

2. The paper guide device of claim 1, wherein the second convey guiding unit includes:

a guiding member rotatably arranged on the first convey guiding unit to guide the paper;

an absorbing member arranged on the guiding member which contacts the image belt to prevent the guiding member from directly contacting the image belt; and an elastic member which elastically pressurizes the guiding member to allow the absorbing member to contact the image belt.

3. The paper guide device of claim 2, wherein the guide member includes a convey guiding plate, the absorbing member includes at least one contacting roller arranged on the convey guiding plate, and the elastic member includes a torsion spring disposed on a rotating axis of the convey guiding plate, the torsion spring having one end supported by the convey guiding plate and another end supported by the first convey guiding unit.

4. The paper guide device of claim 1, wherein the image belt includes at least one photoconductive belt having a photoconductor to form a toner image and an image transfer belt which transfers the toner image on the paper from the photoconductor.

5. An image forming apparatus, comprising:

an image forming unit including a photoconductor which forms a toner image;

a transfer belt unit including an image transfer belt and a transfer roller which transfers the toner image formed on the photoconductor to a sheet of paper;

a paper guiding unit which guides the paper to the transfer belt unit;

a fixing unit which fixes the toner image transferred on the paper; and a paper discharging unit which discharges the toner image transferred paper, wherein the paper guiding unit is arranged within a predetermined space from the image transfer belt and includes a first convey guiding unit spaced apart from the image transfer belt to firstly guide the paper to a nip between the image transfer belt and a transfer roller; and a second convey guiding unit arranged on the first convey guiding unit to contact the image transfer belt to secondly guide the paper to the nip without contacting the image transfer belt.

6. The image forming apparatus of claim 5, wherein the second guiding unit includes:

a guiding member rotatably arranged on the first convey guiding unit to guide the paper;

an absorbing member arranged on the guiding member to contact the image transfer belt to prevent the guiding member from directly contacting the image transfer belt; and an elastic member which elastically pressurizes the guiding member to allow the absorbing member to contact the image transfer belt.

7. The image forming apparatus of claim 6, wherein the guide member includes a convey guiding plate which is longer in the longitudinal direction, the absorbing member includes at least one contacting roller arranged on the convey guiding plate, and the elastic member includes a torsion spring disposed on a rotating axis of the convey guiding plate, the torsion spring having one end supported by the convey guiding plate and another end having a torsion spring supported by the first convey guiding unit.

8. An image forming apparatus, comprising:

an image forming unit including a photoconductive belt forming a toner image;

a transfer unit including a transfer roller which transfers the toner image formed on the photoconductive belt;

a paper guiding unit which guides a paper to the transfer unit;

a fixing unit which fixes the toner image transferred on the paper; and a paper discharging unit which discharges the toner image fixed to the paper, wherein the paper guiding unit is arranged within a predetermined space from the photoconductive belt and includes a first convey guiding unit spaced apart from the photoconductive belt to firstly guiding the paper to a nip between the photoconductive belt and a transfer roller; and a second convey guiding unit arranged on the first convey guiding unit to contact the photoconductive belt to secondly guide the paper to the nip without contacting the photoconductive belt.

9. The image forming apparatus of claim 8, wherein the second guiding unit includes:

a guiding member rotatably arranged on the first convey guiding unit for guiding the paper;

an absorbing member arranged on the guiding member to contact the photoconductive belt to prevent the guiding member from directly contacting the photoconductive belt; and an elastic member which elastically pressurizes the guiding member to allow the absorbing member to contact the photoconductive belt.

10. The image forming apparatus of claim 9, wherein the guide member includes a convey guiding plate which is longer in the longitudinal direction, the absorbing member includes at least one contacting roller arranged on the convey guiding plate, and the elastic member includes a torsion spring disposed on a rotating axis of the convey guiding plate, the torsion spring having one end supported by the convey guiding plate and another end having a torsion spring supported by the first convey guiding unit.

* * * * *